US005818395A

United States Patent [19]

Wolcott et al.

[11] Patent Number: 5,818,395

[45] Date of Patent: Oct. 6, 1998

[54] ULTRALIGHT COLLAPSIBLE AND DEPLOYABLE WAVEGUIDE LENS ANTENNA SYSTEM

[75] Inventors: James L. Wolcott, La Mirada; John R. Bartholomew, III, Torrance; Charles W. Chandler, San Gabriel, all of Calif.

[73] Assignee: TRW Inc., Redondo Beach, Calif.

[21] Appl. No.: 783,710

[22] Filed: Jan. 16, 1997

[51] Int. Cl.[6] ..... H01Q 15/06

[52] U.S. Cl. ..... 343/753; 343/754; 343/915

[58] Field of Search ..... 343/753, 912, 343/915, 754; H01Q 15/06

[56] References Cited

U.S. PATENT DOCUMENTS

| | | | |
|---|---|---|---|
| 2,599,763 | 6/1952 | Kock | 343/753 |
| 3,329,958 | 7/1967 | Anderson | 343/753 |
| 4,321,604 | 3/1982 | Ajioka | 343/753 |
| 5,228,258 | 7/1993 | Onoda et al. | 343/915 |
| 5,257,034 | 10/1993 | Turner et al. | 343/915 |

*Primary Examiner*—Donald T. Hajec
*Assistant Examiner*—Tho Phan
*Attorney, Agent, or Firm*—Michael S. Yatsko

[57] ABSTRACT

A waveguide lens antenna system is shown which includes a collapsible support structure and a collapsible waveguide lens array. The collapsible waveguide lens array includes a plurality of integrally connected tubular waveguide cells that form an array which focuses transmitted signals onto a satellite signal processing device. The array is coupled to a support structure that is affixed to a mounting surface, such as a satellite, and that correctly positions the array when the array is operationally deployed.

21 Claims, 5 Drawing Sheets

ULTRALIGHT COLLAPSIBLE AND DEPLOYABLE WAVEGUIDE LENS ANTENNA SYSTEM

BACKGROUND OF THE INVENTION

1. Technical Field

This invention relates generally to lens antennas, and more particularly to a collapsible lightweight waveguide lens antenna system for use in focusing relatively low frequency microwave satellite signals.

2. Discussion

Large aperture antennas are frequently used in satellite mobile communication applications to focus microwave signals, typically in the L or S band, on a multiple feed panel for signal processing and transmission purposes. Operational and design parameters require that antennas used in satellite communication applications must be compact enough to be stowed during the launch of the satellite, yet large enough to provide high gain at the radio frequencies associated with portable hand-held user terminals.

Several conventional antenna configurations could be utilized in the above-described application. For instance, a planar direct radiating array antenna having sufficient aperture could be utilized. However, the satellite application dictates that in order to provide high enough gain at the relatively low microwave frequencies involved, the antenna utilized at such an application must be on the order of ten meters in diameter. A stowable direct radiating array antenna of such dimensions having sufficiently wide element spacing and structural stiffness is typically commercially impractical due to its high mass and mechanical complexity.

Alternatively, a reflector based antenna, such as a gold-plated wire parabolic reflector antenna of sufficient diameter, could also be utilized in conjunction with a panel of feed elements to produce a multiple-beam array antenna having both high gain and wide area coverage. However, because of the inherent design characteristics of such an antenna, the antenna must be installed on the satellite in a non-symmetrical manner, thereby causing a weight imbalance that adversely affects the performance of the satellite. In addition, such an antenna, because of the materials used in its manufacture, such as gold plated wire and aluminum, cause the antenna to be both expensive and heavy, both being undesirable characteristics.

A lens antenna offers an alternative for the above discussed satellite communication application. Such an antenna design is capable of providing a large aperture and excellent electrical characteristics. However, conventional lens antennas are manufactured from relatively heavy materials, such as bulk ceramic or plastic dielectrics or metal waveguide, that make such antennas impractical for satellite applications where large mass is not tolerable.

In addition, present government regulations require spacecraft antennas over certain dimensional limits to be subject to export controls due to their potential for military exploitation by an adversary. For example, conventional parabolic antennas greater than ten meters in diameter could be used very effectively in military applications such as jamming and electronic intelligence gathering due to their broad operational frequency range. Lens antennas, on the other hand, can be deliberately designed to be ineffective at frequencies outside the narrow band allocated to their intended commercial application. This feature makes the lens virtually useless for the military applications cited above, reducing substantially the likelihood of its being diverted from its intended commercial use after export.

SUMMARY OF THE INVENTION

The present invention provides a commercially practical, lightweight waveguide lens antenna system for use in satellite communication applications. The system of the present invention is constructed of an array of tubular metalized plastic waveguide cells supported by a truss frame. The system is collapsible for storage during satellite launch and exhibits an extremely large aperture to mass ratio. The antenna system, through its design, provides symmetrical balance when installed on the satellite. The shape parameters of the antenna are controlled by simple geometry and not complicated tension control as required in conventional parabolic reflector based antennas. The passive intermodulation performance is also better and more dependable than the parabolic mesh reflector antennas with similar weight characteristics. The system, while intended for satellite based applications, also finds use in radar and other terrestrial applications.

More particularly, the present invention provides an antenna comprising a plurality of tubular waveguide segments each having a predetermined length and interconnected to form a lightweight symmetrical honeycomb array. The plurality of tubular waveguide segments is collapsible for storage and shipment thereof. The antenna also comprises a lightweight rigid frame that supports the plurality of tubular waveguide segments and that has dimensions substantially equal to those of the array when the array is expanded into operational form. The frame is collapsible along with the array for storage and shipment thereof.

BRIEF DESCRIPTION OF THE DRAWINGS

Other objects and advantages of the invention will become apparent upon reading the following detailed description and upon reference to the drawings, in which.

DETAILED DESCRIPTION OF THE PREFERRED EMBODIMENT

Figure 1:
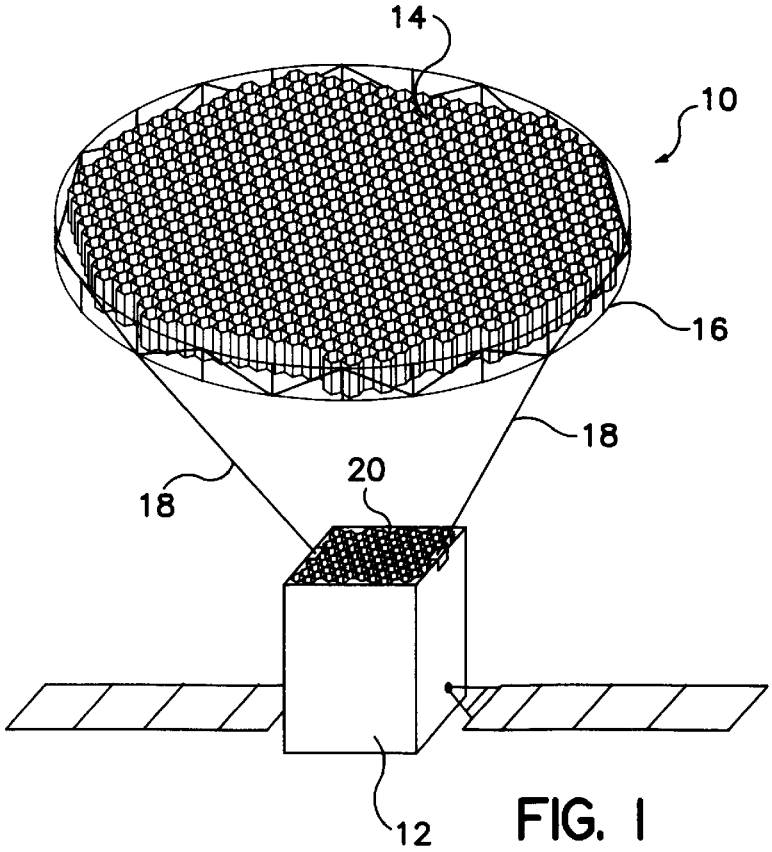
FIG. 1 is a perspective view of a waveguide lens antenna system operatively coupled to a conventional deployed communication satellite.

Referring to FIG. 1, a first embodiment of a waveguide lens antenna system 10 is shown coupled to a conventional deployed communication satellite 12. The antenna system 10 provides high gain for satellite communication signals either transmitted from or received by the satellite 12 at relatively low frequencies in the L or S band (1.2–2.2 Gigahertz). The lens system 10 includes tubular waveguide lens cells, indicated generally at 14, interconnected to form a collapsible honeycomb array. The honeycomb array is supported by a lightweight rigid support frame 16 that, along with the array 14, is collapsible to a size and shape desirable for transport and storage of the antenna system. The support structure 16 is coupled to a pair of support struts 18 which in turn are affixed to the satellite 12 in a manner that correctly positions the antenna system for focusing signals onto a satellite feed panel 20 or, alternatively, for focusing signals transmitted from the satellite 12 to a remote receiving station (not shown) or another satellite (not shown).

Figure 2:
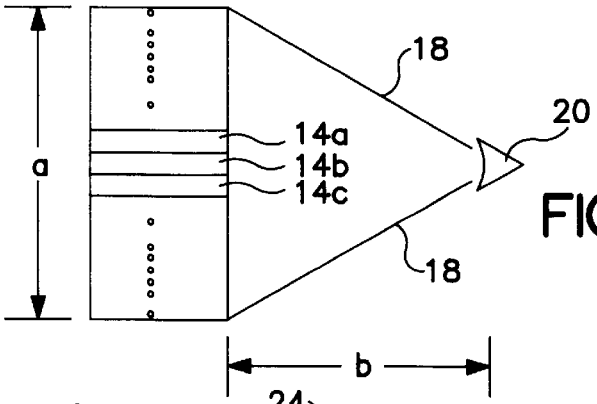
FIG. 2 is a side elevational view of the antenna system shown in FIG. 1.
Figure 3:
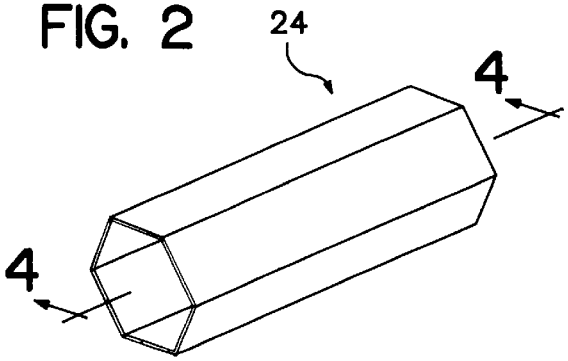
FIG. 3 is a perspective view of one cell of the antenna system shown in FIG. 1.
Figure 4:
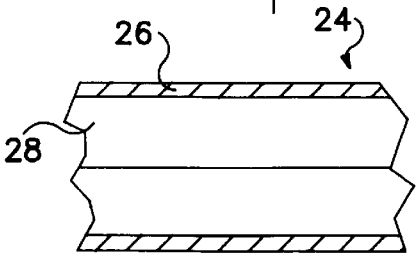
FIG. 4 is a cross-sectional view of the cell of FIG. 3 taken along section line 4—4 in FIG. 3.
Figure 5:
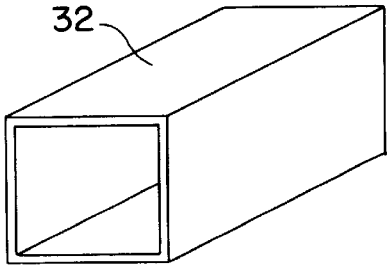
FIG. 5 is a perspective view of a square waveguide cell according to an alternative preferred embodiment of the present invention of the antenna system shown in FIG. 1.
Figure 6:
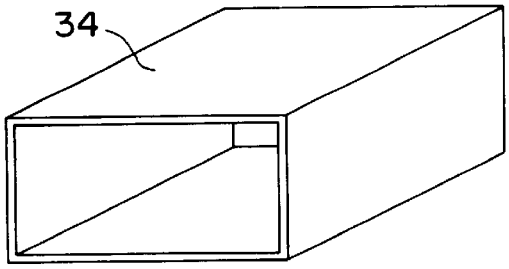
FIG. 6 is a perspective view of a rectangular waveguide cell of an antenna system according to yet another preferred embodiment of the present invention.
Figure 7:
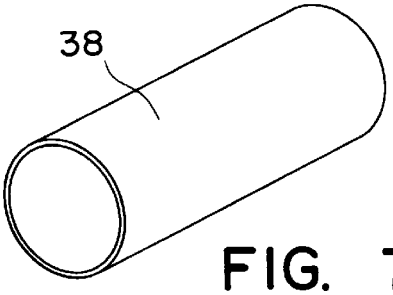
FIG. 7 is a perspective view of a circular waveguide cell of the antenna system of FIG. 1 according to another preferred embodiment of the present invention.

Referring to FIGS. 2–8, the cell array 14 will be discussed in detail. As shown in FIG. 2, the array 14 is constructed of a plurality of cells, such as those shown at 14*a*, 14*b* in a number sufficient to give the circular array a diameter a of approximately 10 feet. According to one preferred embodiment of the present invention, each of the cells in the cell array 14 is hexagonal in cross-section as shown at 24 in FIG. 2*a* with equiangular sides having uniform lengths of about three inches. Each hexagonal cell preferably has a length uniform with other array cells of from six inches to twelve inches, depending upon the particular application and the frequency of the signals to be focused. The array thereby has a focal length b of approximately 9 feet, such that the antenna F/D is about 0.9. As shown in the cross-sectional view of FIG. 4, the cell has an outer wall 26 formed from a lightweight material such as commercially available materials Mylar or Kapton or metal or aluminum film of, for example, 0.0005 inches in thickness. The inner surface of the outer wall 26 is coated with a lightweight metal such as aluminum or silver of approximately three skin depths in thickness to give the cell its waveguide properties.

While the above described array is representative of one preferred embodiment of the present invention, it should be appreciated that the array may be constructed in a variety of configurations, depending upon the particular satellite application. For example, for installation with a satellite, Program Name Thuraya, manufactured by Aerospatiale, the array would have a full scale diameter greater than or equal to thirty feet for focusing multiple one degree beams at 2 GHz.

In addition, the cell dimensions and configurations, while preferably being uniform throughout an array, may also vary according to the particular signals to be transmitted or received. For example, each cell may have a square cross-section as shown at 32 in FIG. 5. Alternatively, each cell may have a rectangular cross-section with dimensions of 1"×5" as shown at 34 in FIG. 6. Cells of rectangular cross-section are used in applications in which satellite signals are linearly polarized. Additionally, each cell may have a uniform circular cross-section having a diameter of three inches, as shown at 38 in FIG. 6. Cells of circular or hexagonal cross-section are used in applications in which satellite signals are circularly polarized. The lengths of each of the cells shown in FIGS. 5–7 again will vary depending upon the particular application.

Figure 8:
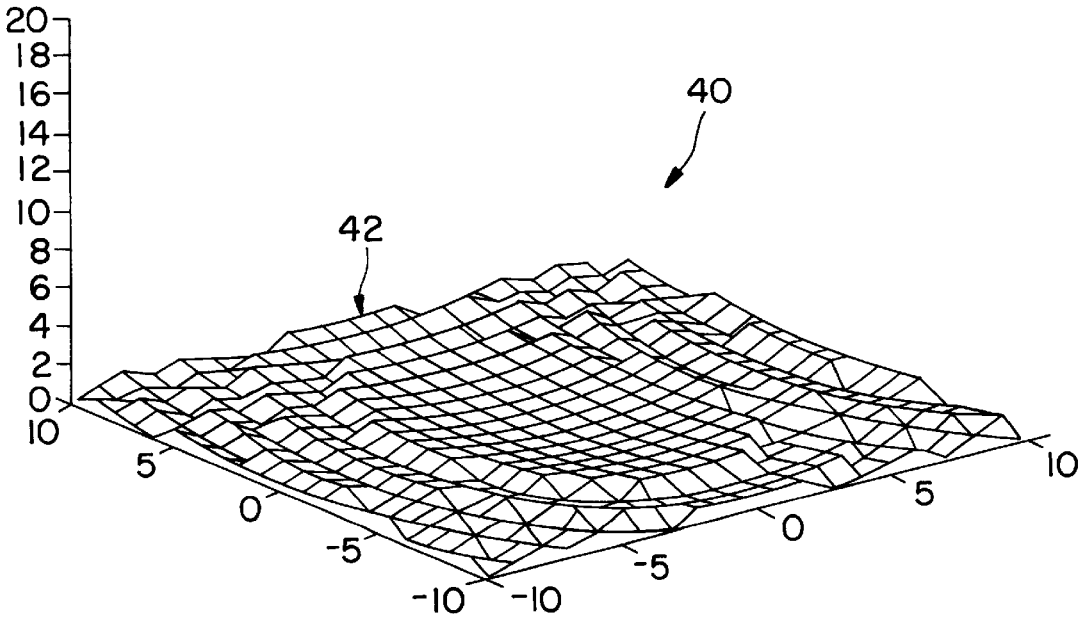
FIG. 8 is a perspective view of the surface contour of a Fresnel lens waveguide array according to an alternative embodiment of the present invention.

Alternatively, the array contour surface may be composed of an array of cells of abruptly-varying length and/or cells arranged in a non-uniform manner. For example, as shown in FIG. 8, a Fresnel lens surface contour is shown at 40 and is composed of a plurality of square cross-section waveguide cells 42 positioned according to the following equation:

$$Z=[(X/0.9)^2+(Y/1.3)^2]/35 \text{ modulo } 1$$

Figure 9A:
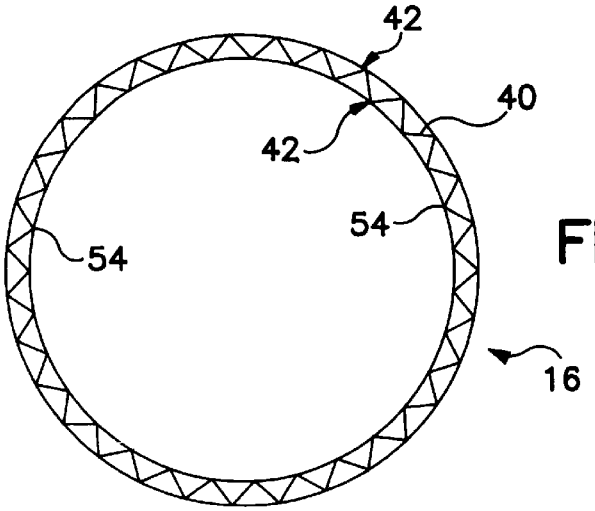
FIG. 9A is a plan view of the support structure of the antenna system according to a preferred embodiment of the present invention.
Figure 9B:
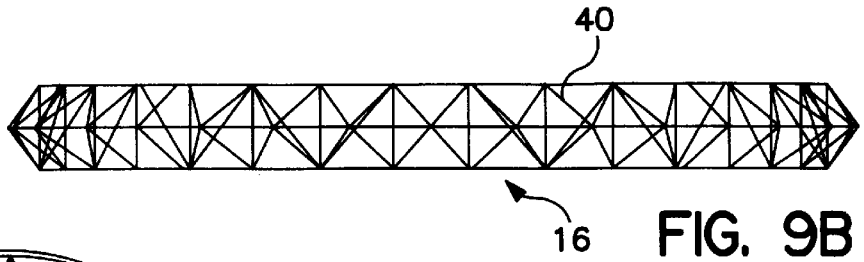
FIG. 9B is a side elevational view of the support structure shown in FIG. 9A.
Figure 9C:
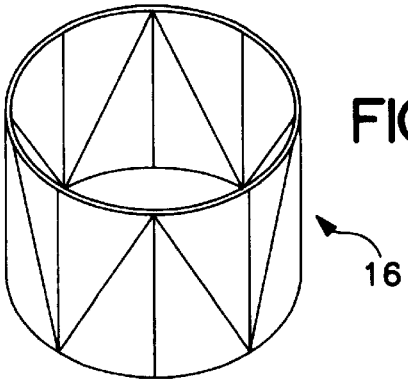
FIG. 9C is a perspective view of the support structure shown in FIG. 9A.
Figure 10:
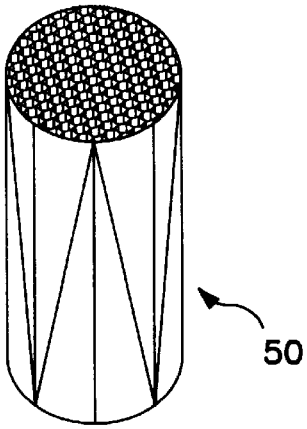
FIG. 10 is a side elevational view of the antenna system of FIG. 1 in a collapsed configuration.
Figure 11:
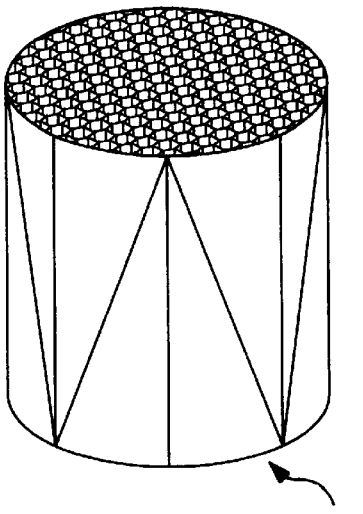
FIG. 11 is a side elevational view of the antenna system shown in FIG. 1 in a partially deployed configuration.

Referring now to FIGS. 9–12, the support structure 16 will now be described in greater detail. The support structure 16 shown in FIGS. 9A–9C is circular in shape when fully deployed and, as shown in FIGS. 9A–9C, is preferably a truss frame having individual load bearing members, such as that indicated at 40, composed of graphite or some other durable lightweight material having structural integrity characteristics similar to those of graphite. As shown in FIG. 9, each of the load bearing members is associated with two pivot joints 42 that maintain each load bearing member in a fully extended operational position when the antenna system is deployed, but that allow the support structure to be collapsed inwardly along with the cell array, as shown at 50 in FIG. 10, for transport and storage of the entire antenna system. Alternatively, the support structure and associated cell array may be partially collapsed, as shown at 52 in FIG. 11 for partial deployment of the antenna in response to a particular application. The support structure also includes fastening mechanisms 54, such as tension plates and elastic connectors, which are used to secure the array of waveguide cells to the support structure.

Figure 12:
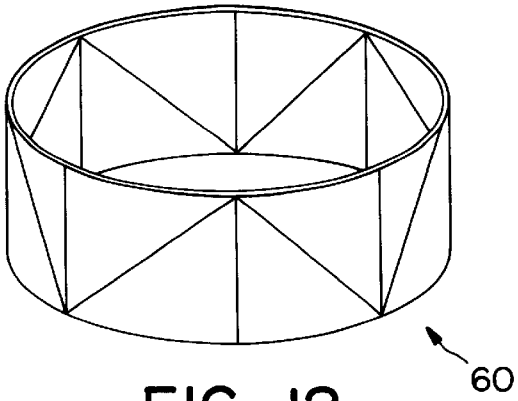
FIG. 12 is a perspective view of an elliptical support structure for an antenna system according to another preferred embodiment of the present invention.
Figure 13:
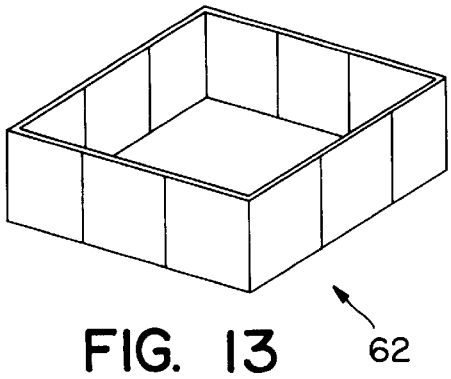
FIG. 13 is a perspective view of a hexagonal support structure according to yet another preferred embodiment of the present invention.
Figure 14:
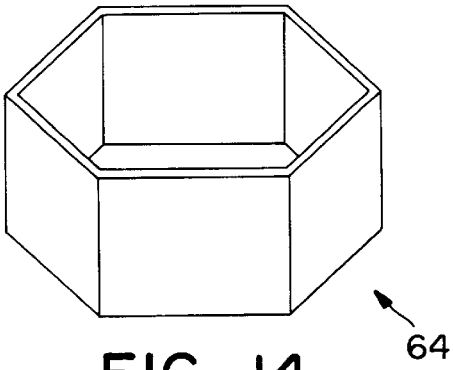
FIG. 14 is a perspective view of a rectangular support structure according to a further preferred embodiment of the present invention.

While the above described circular support structure represents one preferred embodiment for use with the antenna system of the present invention, it should be appreciated that numerous other support structure configurations may be utilized, depending upon the particular desired waveguide cell array configuration to be deployed. As shown in FIG. 12, the support structure may be formed from an elliptical truss frame 60. Alternatively, as shown in FIG. 13, the support structure may be configured as a rectangular truss frame 62. Also, the support structure may be configured as a hexagonal support structure 64 formed from individual panels, such as graphite sandwich panels, and hinged in a manner that allows the support structure to be collapsed along with the waveguide cell array. Thus, from the above described configurations of both the waveguide cell array and the array support structure, it should be appreciated that the antenna system of the present invention may be structured in a variety of configurations and may be manufactured from a variety of lightweight materials.

Figure 15:
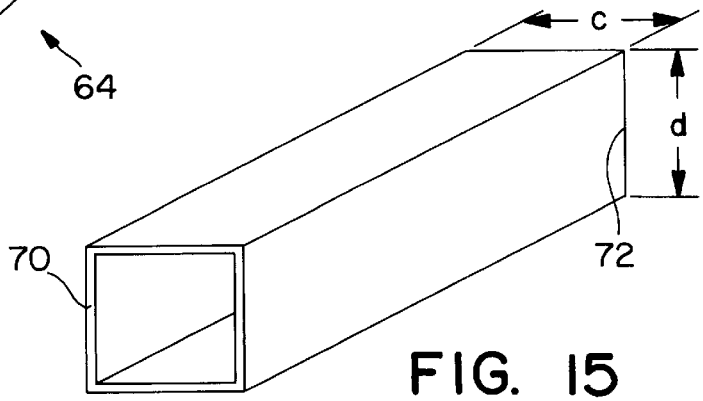
FIG. 15 is a perspective view of a feed horn of the antenna system shown in FIG. 1.

Referring now to FIG. 15, a feed horn 20 for use with the above described satellite system 10 is shown in more detail. Although more than one feed horn may be utilized with the satellite 12, it is contemplated that a single position adjustable feed horn would provide sufficient signal focusing characteristics. The feed horn shown has six-inch square dimensions at a first end 70. The horn tapers to a second end 72 having a width c of about six inches and a height d of about 2.55 inches. The feed horn length from the first end 70 to the second end 72 is preferably about twelve inches for use with signals having frequencies of about two gigahertz (Ghz).

The following Table provides a set of exemplary structural and operational parameters for various configurations of the antenna systems described above:

| Array Diameter | Cell Cross-Section | Cell Length |
|---|---|---|
| 12 m diameter | 3" hexagonal opening | 12 inches deep for Geomobile subscriber service |
| 6 m diameter | 1.5" hexagonal opening | 12 inches deep for uplink |
| 2 m diameter | rectangular opening | 6 inches deep for linearly polarized ground link |

Referring now to FIGS. 16–19, a preferred method of manufacturing the lens waveguide cell array of the present invention will be described. While the method described below represents a preferred method of manufacturing a hexagonal cell array, it should be appreciated that arrays having waveguide cells of other configurations, such as circular or square waveguide cells, are manufactured in a similar manner.

Figure 16:
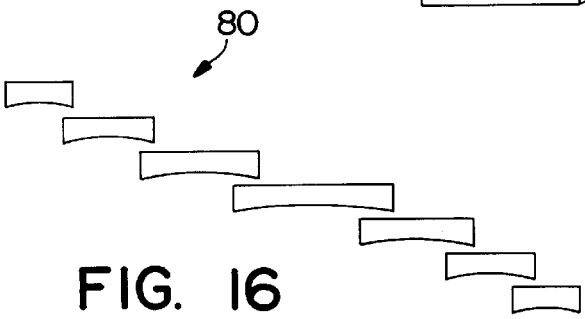
FIGS. 16–18 illustrate a preferred method of manufacturing a lens waveguide array for the antenna system of the present invention.
Figure 17:
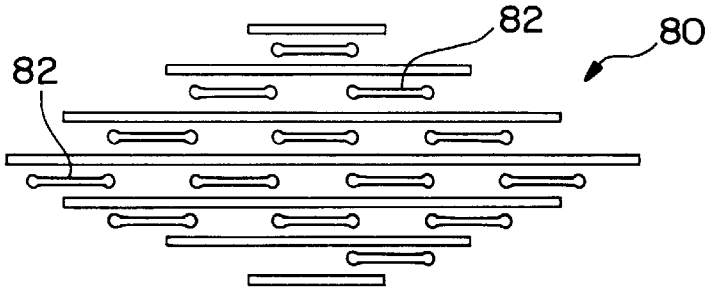
Figure 18:
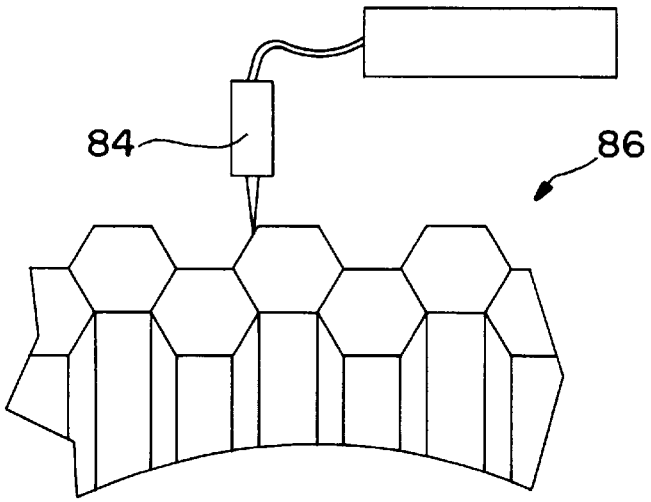

Referring to FIG. 16, a side view of multiple sheets of metalized plastic film, such as those sold commercially under the tradenames Mylar and Kapton, are arranged in a stacked manner as shown at 80. As shown in the plan view in FIG. 17, the multiple layers of metalized plastic film 80 are discretely welded together to bond the individual sheets together as a single unit, indicated by the welded joints 82. As shown in FIG. 18, the individual waveguide cells are formed or fabricated by cutting through the individual sheets with a tool shown at 84. Preferably, the cutting process is accomplished through use of a conventional two axis laser cutting tool. However, any appropriate cutting tool capable of cutting with a high degree of accuracy may be used. The individual hexagonal waveguide cells are formed such that the interior walls of the waveguide cells are metal coated and each end of the cell is open. Subsequently, as shown at 86 in FIG. 18, the cell array is cut so that each waveguide cell has a length according to the particular application. By forming an array as described above, the resulting array may be collapsed for storage and transport purposes, thereby minimizing the storage/cargo space required.

Upon reading the foregoing description, it should be appreciated that the antenna system of the present invention provides numerous advantages over conventional direct radiating array antennas and reflector based antennas. The lightweight lattice array structure of the antenna system of the present invention promotes balanced, torsional support along the antenna cardinal axes. In addition, the optical properties of the antenna are controlled by simple geometry, not complicated tension control as in conventional parabolic mesh reflector antennas. Further, the passive intermodulation performance exhibited by the antenna system of the present invention represents an improvement in performance and dependability over conventional parabolic mesh reflector antennas while having similar overall weight characteristics. The antenna system of the present invention also may be constructed to conform to a wide range of antenna F/D requirements. The antenna system of the present invention can also accommodate aspheric, multi-focal and other similar complex optical configurations.

It should also be appreciated that, while the antenna system of the present invention is primarily intended for space-borne communication applications, it is contemplated that the antenna system may also be utilized in radar, as well as other terrestrial applications, or in any application requiring a large, lightweight, stowable antenna.

Various other advantages of the present invention will become apparent to those skilled in the art after having the benefit of studying the foregoing text and drawings, taken in conjunction with the followings claims.

What is claimed is:

1. A waveguide lens antenna system, comprising:

a support structure having means to permit its collapsing;

a lens waveguide antenna mounted to said support structure and including a plurality of integrally connected tubular waveguide cells that form a cell array that focuses transmitted signals onto a signal processing device; said lens waveguide antenna having means to permit its collapsing and a second support structure mount that operatively connects said collapsible support structure to a mounting surface to correctly position said collapsible lens waveguide antenna relative to said signal processing device when said antenna is operationally deployed.

2. The system of claim 1, wherein said plurality of integrally connected tubular waveguide cells is formed from a plurality of metalized plastic film sheets.

3. The system of claim 1, wherein said plurality of integrally connected tubular waveguide cells are hexagonal in cross-section for focusing circularly polarized signals.

4. The system of claim 1, wherein said plurality of integrally connected tubular waveguide cells are circular in cross-section for focusing circularly polarized signals.

5. The system of claim 1, wherein said plurality of integrally connected tubular waveguide cells are rectangular in cross-section for focusing linearly polarized signals.

6. The system of claim 1, wherein said collapsible support structure is hexagonal in shape and said collapsible waveguide lens array conforms to same.

7. The system of claim 1, wherein said collapsible support structure is circular in shape and said collapsible waveguide lens array conforms to same.

8. The system of claim 1, wherein said collapsible support structure is rectangular in shape and said collapsible waveguide lens array conforms to same.

9. The system of claim 1, wherein each of said plurality of integrally connected waveguide tubular cells is formed from a material selected from a group consisting of: metalized Mylar, Kapton, and aluminum film.

10. The system of claim 1, wherein said collapsible support structure comprises a truss frame.

11. The system of claim 10, wherein said truss comprises a graphite fiber truss frame.

12. An antenna, comprising:

a plurality of tubular lens waveguide cells each having a predetermined length and being interconnected to form a lightweight symmetrical honeycomb array, said plurality of tubular lens waveguide cells being collapsible for storage and shipment thereof; and a lightweight rigid frame that supports said plurality of tubular lens waveguide cells and that has dimensions substantially equal to those of said array when said array is expanded into operational form, said frame having means to permit its collapsing along with said array for storage and shipment thereof.

13. The lens of claim 12, wherein said plurality of tubular waveguide cells forms a fresnel lens surface contour.

14. The antenna of claim 12, wherein said plurality of integrally connected tubular waveguide cells are hexagonal in cross-section for focusing circularly polarized signals.

15. The antenna of claim 12, wherein said plurality of integrally connected tubular waveguide cells are circular in cross-section for focusing circularly polarized signals.

16. The antenna of claim 12, wherein said plurality of integrally connected tubular waveguide cells are rectangular in cross-section for focusing linearly polarized transmission signals.

17. The antenna of claim 12, wherein each of said plurality of interconnected tubular waveguide cells is formed from a material selected from a group consisting of: metalized Mylar, Kapton and aluminum film.

18. A method of manufacturing a waveguide lens antenna, comprising the steps of:

stacking a plurality of sheets of metalized plastic film having substantially uniform dimensions;

joint welding each of said plurality of sheets of metalized plastic film to adjacent sheets to bond said plurality of sheets of metalized plastic film in a predetermined configuration;

cutting said predetermined configuration to form an array of waveguide cells that may be expanded for deployment thereof and collapsed for storage and transport thereof.

19. The method of claim 18, wherein said step of cutting said predetermined configuration comprises cutting said predetermined configuration with a two axis laser cutting tool.

20. The method of claim 18, further comprising the step of cutting said plurality of formed waveguide cells to a predetermined length.

21. The method of claim 18, wherein said step of cutting said predetermined configuration precedes said steps of stacking a plurality of sheets and joint welding each of said plurality of sheets.

* * * * *